US005524539A

United States Patent [19]

Döbler

[11] Patent Number: 5,524,539

[45] **Date of Patent: *Jun. 11, 1996**

[54] DEVICE FOR THE PRINT SETTING OF A PRINTING CYLINDER EQUIPPED WITH A SLIP-ON SLEEVE

[75] Inventor: Hermann Döbler, Plauen, Germany

[73] Assignee: Man Roland Druckmaschinen AG, Offenbach am Main, Germany

[ * ] Notice: The term of this patent shall not extend beyond the expiration date of Pat. No. 5,421,260.

[21] Appl. No.: 374,329

[22] Filed: Jan. 18, 1995

[30] Foreign Application Priority Data

Jan. 18, 1994 [DE] Germany ..... 44 01 301.9

[51] Int. Cl.[6] ..... B41F 13/24

[52] U.S. Cl. ..... 101/247; 101/185; 101/145; 101/192; 101/209

[58] Field of Search ..... 101/137, 139, 101/140, 143, 144, 145, 177, 182, 184, 185, 191, 192, 209, 216, 218, 247, 284, 285

[56] References Cited

U.S. PATENT DOCUMENTS

| | | | |
|---|---|---|---|
| 4,369,705 | 1/1983 | Gelinas | 101/218 |
| 4,458,591 | 7/1984 | Guaraldi | 101/218 |
| 4,622,895 | 11/1986 | Dorow et al. | 101/216 |
| 5,237,920 | 8/1993 | Guaraldi | 101/216 |
| 5,241,905 | 9/1993 | Guaraldi et al. | 101/216 |
| 5,421,260 | 6/1995 | Dobler | 101/145 |

FOREIGN PATENT DOCUMENTS

| | | | |
|---|---|---|---|
| 0277545 | 8/1988 | European Pat. Off. . | |
| 1238929 | 4/1967 | Germany . | |
| 3614027 | 10/1987 | Germany . | |
| 9215598 | 6/1992 | Germany . | |
| 172739 | 8/1986 | Japan | 101/216 |

*Primary Examiner*—Ren Yan

*Attorney, Agent, or Firm*—Cohen, Pontani, Lieberman, Pavane

[57] ABSTRACT

In a rotary printing machine, a device for the print setting of a printing cylinder equipped with a slip-on sleeve. The printing cylinder is supported in a bearing to which an eccentric bushing is secured for reciprocating the printing cylinder between print engagement and disengagement positions. The device includes a coupling rod secured to the eccentric bushing for reciprocating the latter, and the coupling rod is joined to the eccentric bushing by a separable joint such that the coupling rod may be swung out of the area of the frame opening to accommodate changing of the sleeve without removing the printing cylinder from the printing machine.

19 Claims, 2 Drawing Sheets

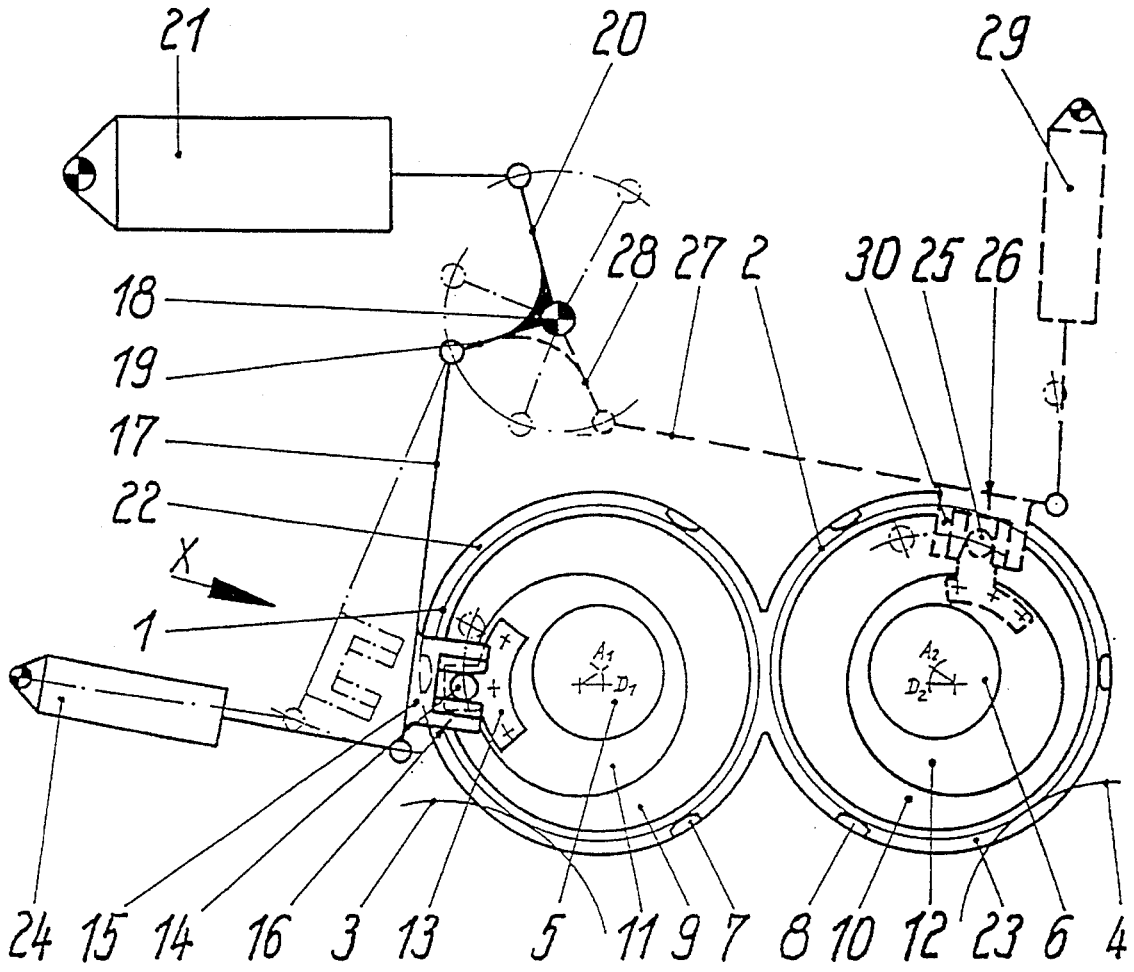
Fig. 1
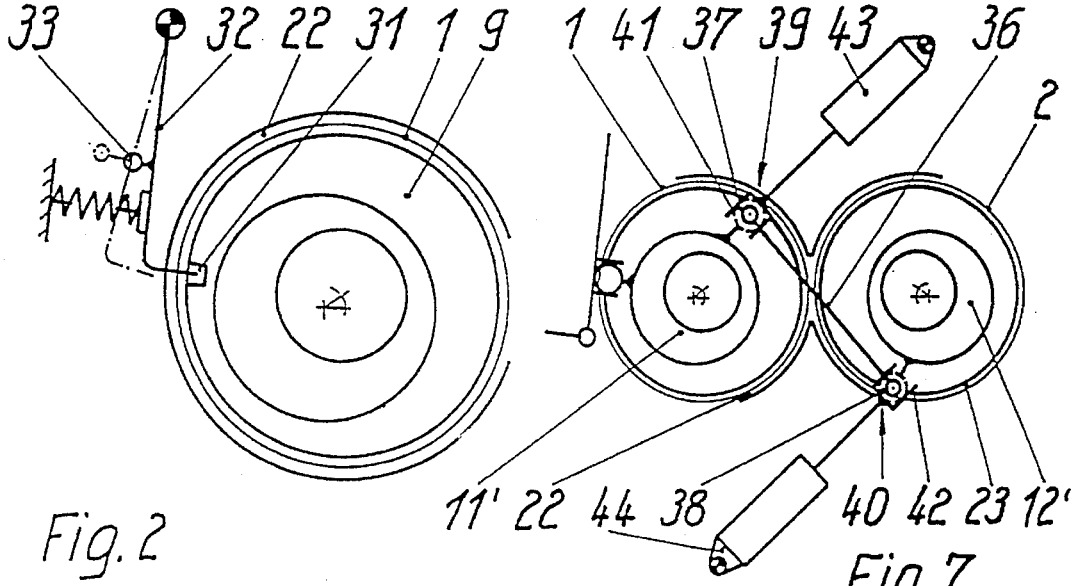
Fig. 2
Fig. 7

DEVICE FOR THE PRINT SETTING OF A PRINTING CYLINDER EQUIPPED WITH A SLIP-ON SLEEVE

BACKGROUND OF THE INVENTION

1. Field of the Invention

The present invention pertains to devices for the print setting of a printing cylinder, and more particularly to printing cylinders equipped with slip-on sleeves.

2. Description of the Related Art

It is generally known to connect a coupling rod of a multi-element linkage mechanism to an eccentric bushing formed on the bearing of a printing cylinder such that the bushing may be rotated for the print engagement and disengagement of the printing cylinder. See, for example, DE-GM 91 15 598, DE-AS 12 38 929 AND DE-PS 36 124 027.

However, in the case of printing cylinders equipped with slip-on sleeves, the known arrangements do not accommodate changing of the sleeve without removing the printing cylinder, as the known arrangements block the removal and placement of the sleeve through an opening in the frame.

It is therefore an object of the invention to provide a device for the print setting of a printing cylinder which allows a slip-on sleeve on such cylinder to be changed while the printing cylinder remains in place in the printing machine.

SUMMARY OF THE INVENTION

The present invention is for use in a printing machine having a frame defining an opening, the invention comprising a device for moving a printing cylinder between print engagement and disengagement positions and which accommodates changing of a slip-on sleeve on the printing cylinder through the opening in the frame. The printing machine includes a bearing supporting the printing cylinder to which an eccentric bushing is secured, and the device of the invention comprises a coupling rod adjacent to the opening in the frame for reciprocating the bushing for moving the printing cylinder between the print engagement and disengagement positions, and a separable joint joining the coupling rod to the eccentric bushing, the joint having one part secured to the bushing and one part secured to the coupling rod, whereby the coupling rod may be swung out of the area of the frame opening for accommodating changing of the slip-on sleeve.

In a preferred embodiment the separable joint comprises a bearing bolt and a bearing shell, one of which is secured to the eccentric bushing and the other to the coupling rod. The coupling rod is swung out of the area of the frame opening by a swing member which may comprise a pressure operated working cylinder, an electric motor or other suitable device.

In the preferred embodiment, a stop is releasably secured to the bearing for securing the bearing against rotational movement. The stop is joined to the coupling rod for movement therewith out of the area of the frame opening to allow changing of the sleeve on the printing cylinder. The stop may comprise a latch secured to the frame of the printing machine and having a stop member biased into a recess in the bearing, the latch including an element secured to the coupling rod for retracting the stop from the recess and moving the latch out of the area of the frame opening when the coupling rod is swung away from the frame opening. In this embodiment the latch is secured to the coupling rod to accommodate relative movement between the two when the coupling rod is reciprocated for reciprocating the eccentric bushing for moving the printing cylinder between its print engagement and disengagement positions.

The coupling rod may be driven by a reciprocating driving link which, in turn, may be driven by a pressure operated working cylinder pivotally mourned to the frame of the printing machine, or by any other suitable device. Instead of a reciprocating driving link, the coupling rod may be driven directly, as by an adjustment element on a motor.

The present invention may also be employed in a printing machine having two printing cylinders, both of which are movable between print engagement and disengagement positions, and both of which have slip-on sleeves. In this event, a second coupling rod may be added which, like the first, is joined to the eccentric bushing on the second printing cylinder by a separable joint. The second coupling rod may be reciprocated for driving the eccentric bushing by a second reciprocating driving link connected at an angle to the first, and both driving links may, in such event, be secured to a common synchronizing shaft driven as by a pressure operated working cylinder. Alternatively, instead of two coupling rods, a common coupling rod may be employed having at either end a separable joint for connection to the eccentric bushings of the respective printing cylinders.

The various features which characterize the present invention are pointed out with particularity in the claims annexed to and forming part of this disclosure. For a better understanding of the invention, its operating advantages, and specific objects attained by its use, reference should be made to the following detailed description in conjunction with the accompanying drawings in which there are illustrated and described currently preferred embodiments of the invention. It is to be understood, however, that the detailed description and drawings are intended to illustrate and not to define the limits of the invention, for which reference should be made to the appended claims.

BRIEF DESCRIPTION OF THE DRAWINGS

In the drawings, wherein like numerals represent like parts:

FIG. 1 is a partly elevational, partly schematic view showing a dual cylinder printing unit for indirect printing equipped with a device in accordance with the invention;

FIG. 2 is a partly elevational, partly schematic view of one of the printing cylinders in FIG. 1 showing a releasable mechanism which operates in cooperation with the coupling rod for locking a bearing supporting the printing cylinder;

FIG. 7 is a view similar to FIG. 1 and showing a modified coupling rod suitable for engaging the eccentric bushings of both transfer printing cylinders.

DETAILED DESCRIPTION OF THE PREFERRED EMBODIMENTS

Figure 3:
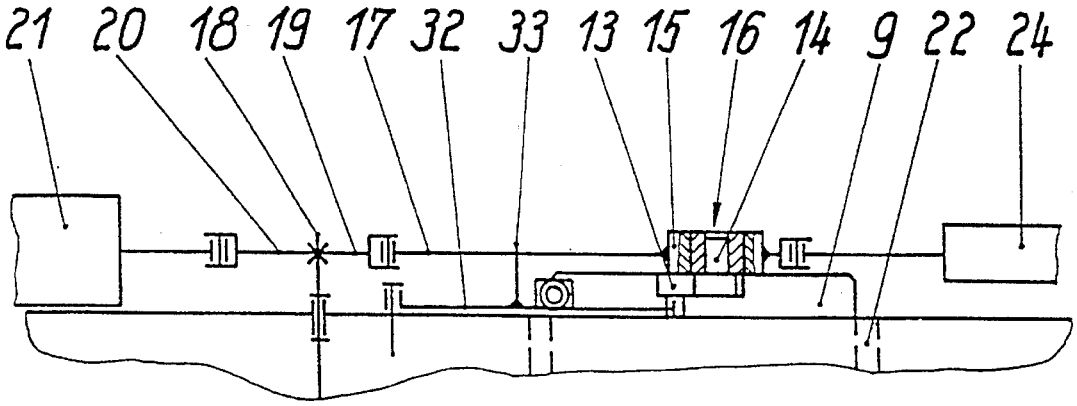
FIG. 3 is a partly schematic view of FIG. 1 as seen in the direction of the arrow X.

Referring now to the drawings, FIGS. 1 and 3 show a dual cylinder printing unit for the indirect printing of both sides of a web (not shown) and which includes two transfer printing cylinders 1, 2, each of which is equipped with a slip-on sleeve provided with a resilient outer layer of rubber or plastic. Also shown in FIG. 1 are two form cylinders 3, 4, one for each printing cylinder 1, 2, respectively. The transfer printing cylinders 1, 2 are mounted by their respective axle journals 5, 6 in eccentric bushings 11, 12, respectively. The eccentric bushings 11, 12 are, in turn, supported for rotation in respective bearings 9, 10 which are supported at their circumferences by movable support bodies 7, 8.

Still referring to FIGS. 1 and 3, a connector 13 is screwed to the end face of the eccentric bushing 11 and a bearing bolt 14 mounted to the connector 13 extends in the axial direction of the printing cylinder 1. A bearing shell 15 is dimensioned to receive the bolt 14 such that the bolt 14 and bearing shell 15 together define a releasable joint 16. The bearing shell 15 is connected to a coupling rod 17 of a multi-member linkage mechanism such that when the bearing shell 15 engages the bolt 14 the coupling rod 17 functions to reciprocate the eccentric bushing 11 between the print engagement and disengagement positions, D1 and A1 respectively, of the transfer printing cylinder 1.

The coupling rod 17 is connected to a reciprocating link member 19 which, in turn, is mounted on one end of a synchronizing shaft 18. A conventional fixed coupling rod (not shown) is mounted on the other end of the shaft 18 and connected to the bearing on the other side of the transfer printing cylinder 1 for cooperating with the coupling rod 17 for moving the cylinder 1 between its print engagement and disengagement positions D1, A1. A pressure operated working cylinder pivotally mounted on the frame of the printing unit drives a lever 20 fixedly connected to the link member 19 for driving the latter in the manner indicated by the phantom lines in FIG. 1.

To accommodate changing of the slip-on sleeves of the transfer printing cylinders 1, 2, the machine frame is equipped on one side with respective frame openings 22, 23 through which the sleeves may be withdrawn and inserted. For changing the sleeves, the cylinders 1, 2 are in their respective prim disengagement positions and the bearing bushings 9, 10 are released by the respective support bodies 7, 8, the cylinders remaining supported in a conventional manner (not shown). To accommodate the sleeve change for the printing cylinder 1 the coupling rod 17 must be swung away from the area of the frame opening 22 as the bearing shell 15 of the joint 16 is separated from the bearing bolt 14. This is accomplished by the working cylinder 24 which, as shown in FIG. 1, is connected to the coupling rod 17 for swinging the rod 17 to the position indicated by the phantom lines, and which acts at other times to secure the positive connection between the bearing shell 15 and the bolt 14.

The mechanism for moving the transfer printing cylinder 2 into its respective print engagement and disengagement positions, D2 and A2, and for swinging its corresponding coupling rod away from the frame opening 23 is analogous to that described hereinabove for the case of the transfer printing cylinder 1. More particularly, a bearing bolt 25 is secured to a connection piece mounted to the face of the eccentric bushing 12, and a bearing shell 30 defines with bolt 25 a separable joint 26. The bearing shell 30 is connected to the coupling rod 27 for the printing cylinder 2, and the other end of the coupling rod is connected to a reciprocating drive link 28 which, like drive link 19, is fixedly mounted on the synchronizing shaft 18 at an angle to drive link 19. In a manner analogous to the coupling rod 17, the coupling rod 27 is swingable away from the frame opening 23 by a working cylinder 29 connected to the coupling rod.

Referring to FIGS. 2 and 3, each bearing 9, 10 is equipped with a stop which secures them against turning during normal operation of the printing unit. As the stops are identical, only the stop for bearing 9 is described. As shown, the stop includes a latch 32 urged by a spring force into a recess 31 in the bearing 9 for arresting the bearing against rotational movement. Extending from the latch is a pin 33 secured to the coupling rod 17 such that as the coupling rod is swung away from the area of the frame opening 22, the latch 32 is likewise retracted from the recess 31 and swung away from the frame opening 22 to allow changing of the slip-on sleeve for the transfer printing cylinder 1. The connection between the pin 33 and coupling rod 17 accommodates relative movement between the coupling rod 17 and latch 32 during reciprocating movement of the coupling rod. Alternatively the pin may be fixed to the coupling rod and movably secured to the latch.

Figure 4:
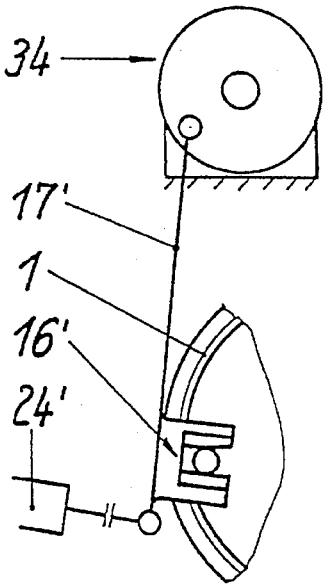
FIG. 4 is a partial elevational view, partly schematic, showing an alternative drive mechanism for the coupling rod which employs a geared motor.
Figure 5:
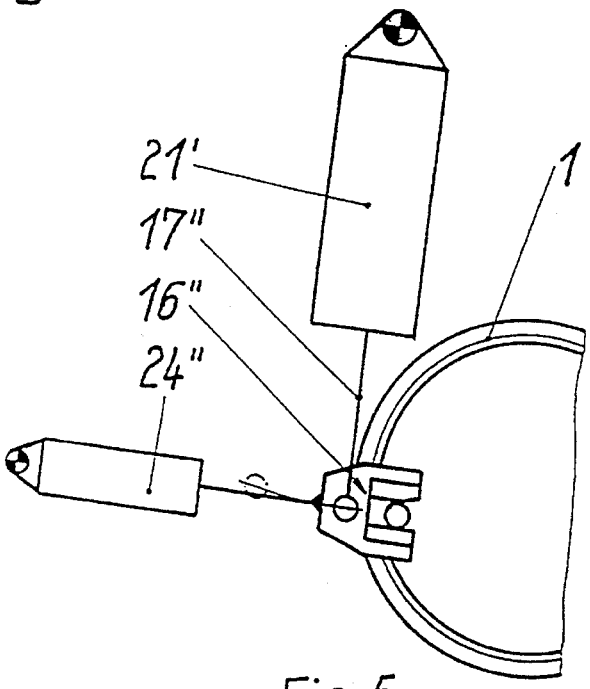
FIG. 5 is a view similar to FIG. 4 showing another drive mechanism for the coupling rod which employs a piston rod.
Figure 6:
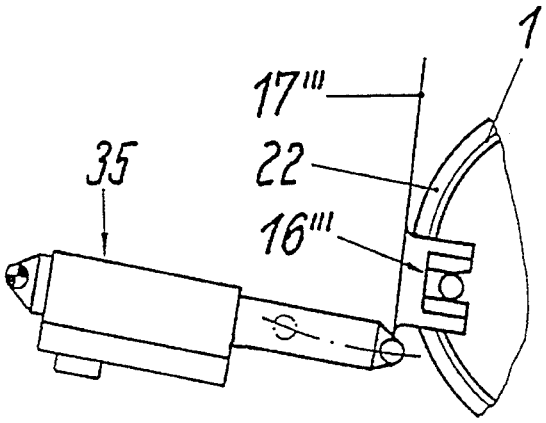
FIG. 6 is another view similar to FIG. 4 showing an alternative mechanism which employs a linear drive for moving the coupling rod out of engagement with the printing cylinder.

Having described a preferred embodiment of the invention, alternative embodiments will now be described. Referring first to FIG. 4, the coupling rod 17' is connected to and reciprocated between its print engagement and disengagement positions by an electromotor and adjusting element 34 that is driven in the movement direction of the eccentric busing. Referring to FIG. 5, as a further alternative, the coupling rod 17" comprises the piston rod of a working cylinder 21' pivotally mounted on the machine frame. In FIG. 6, the coupling rod 17'" is swung out of the area of the frame opening 22 by an electric drive 35 mounted pivotally on the machine frame.

Referring lastly to FIG. 7, the coupling rods 17 and 27 of FIG. 1 may be replaced by a single coupling rod 36 for the common setting of the print engagement and disengagement positions of the printing cylinders 1, 2. As shown, bearing bolts 37, 38 attached to the eccentric bushings 11', 12' form, with the respective bearing shells 41, 42, separable joints 39, 40. The bearing shells 41, 42 are coupled to the connecting rod 36 for reciprocating the printing cylinders 1, 2 and are also connected to the pressure-operated working cylinders 43, 44 which are pivotally mounted to the machine frame and which serve to swing the coupling rod 36 out of the area of the frame openings 22, 23 during changing of the slip-on sleeves. To insure that the coupling rod follows the correct path as it is swung away from one or the other of the frame openings, when one of the joints 39, 40 is separated, the other remains in its operating position.

Advantageously, the bearing shells 15, 30, 41, 42 are covered with a replaceable, wear-resistant material having a low fiction surface for engagement with the bearing bolts 14, 25, 37, 38.

Furthermore, it should be understood that the invention may be employed with any settable printing cylinder equipped with a slip-on sleeve. Likewise, in a manner not shown, the transfer cylinder 1 may work together with a counter-pressure cylinder for one-sided indirect printing, in which event transfer cylinder 2 is eliminated.

While herein shown and described are the presently preferred embodiments of the invention and certain variations thereof, the invention is not intended to be limited to the embodiments depicted, but rather is defined as to scope by the annexed claims.

I claim:

1. In a printing machine having a frame defining a first opening, a device for moving a first printing cylinder equipped with a slip-on sleeve between print engagement and disengagement positions and which accommodates changing of said slip-on sleeve on said printing cylinder through said opening, said printing machine including a bearing supporting said printing cylinder and having an eccentric bushing, said device comprising a coupling rod adjacent said frame opening for reciprocating said eccentric bushing for moving said printing cylinder between said print engagement and disengagement positions, and a first separable joint joining said coupling rod to said eccentric bushing, said joint having one part secured to said eccentric bushing and one part secured to said coupling rod, means for separating said separable joint and for swinging said coupling rod out of the area of said frame opening for accommodating changing of said slip-on sleeve.

2. The device according to claim 1, wherein said separable joint comprises a bearing bolt and a bearing shell, one of said bearing bolt and bearing shell being secured to said eccentric bushing and the other of said bearing bolt and said bearing shell being secured to said coupling rod.

3. The device according to claim 1, further comprising a swing member for swinging said coupling rod out of the area of said frame opening, said swing member comprising a pressure operated working cylinder pivotally mounted to the frame of the printing machine.

4. The device according to claim 1, further comprising a stop releasably securing the bearing against rotational movement, said stop being joined to said coupling rod for movement therewith out of the area of said frame opening.

5. The device according to claim 4, wherein the stop comprises a latch secured to the frame of the printing machine and having a stop member biased into a recess in said bearing, the latch including an element secured to said coupling rod for retracting said stop member from said recess and moving said latch out of the area of said frame opening when said coupling rod is swung out of the area of said frame opening.

6. The device according to claim 5, wherein said element of said latch secured to said coupling rod comprises a pin member extending perpendicularly to said coupling rod and movably secured to one of said coupling rod and said latch for accommodating movement of said coupling rod relative to said latch during reciprocating movement of said eccentric bushing.

7. The device according to claim 1, further comprising a first reciprocating driving link connected to said coupling rod and movable in the movement direction of said eccentric bushing for driving said coupling rod for reciprocating said eccentric bushing.

8. The device according to claim 7, further comprising a pressure operated working cylinder pivotally mounted to the frame of the printing machine and connected to said reciprocating driving link for reciprocating said driving link for moving said printing cylinder between said print engagement and disengagement positions.

9. The device according to claim 7, wherein said printing machine includes a second printing cylinder moveable between print engagement and disengagement positions and equipped with a slip-on sleeve, and a second eccentric bushing for said second printing cylinder, and wherein said frame includes a second opening for accommodating changing of said slip-on sleeve on said second printing cylinder, wherein said device further comprises a second coupling rod adjacent said second frame opening and connected to said second eccentric bushing for reciprocating said second eccentric bushing for moving said second printing cylinder between said print engagement and disengagement positions, a second separable joint joining said second coupling rod to said second eccentric bushing, said second joint having one part secured to said second eccentric bushing and one part secured to said second coupling rod, a second reciprocating driving link connected to said second coupling rod and to said first reciprocating driving link at an angle thereto, and a common drive member for driving said first and second reciprocating driving links for moving said first and second cylinders between said print engagement and disengagement positions.

10. The device according to claim 9, further comprising a swing member connected to each of said first and second coupling rods for moving said first and second coupling rods out of the area of said first and second frame openings, respectively, for accommodating changing of said slip-on sleeves on said first and second coupling rods out of the area of said first and second frame openings, respectively, for accommodating changing of said slip-on sleeves on said first and second printing cylinders.

11. The device according to claim 9, wherein said first and second reciprocating driving links are connected to a common synchronizing shaft.

12. The device according to claim 1, further comprising a motor having an adjusting element driven in the movement direction of said eccentric bushing, and wherein said coupling rod is connected to said adjusting element to be driven thereby for reciprocating said eccentric bushing.

13. The device according to claim 1, further comprising a pressure operated working cylinder pivotally mounted to said frame of said printing machine and driving a piston, and wherein said piston comprises said coupling rod, whereby said driven coupling rod reciprocates said eccentric bushing.

14. The device according to claim 1, wherein said printing machine includes a second printing cylinder moveable between print engagement and disengagement positions and equipped with a slip-on sleeve, and a second eccentric bushing for said second printing cylinder, and wherein said frame includes a second opening for accommodating changing of said slip-on sleeve on said second printing cylinder, wherein said device further comprises a second separable joint joining said coupling rod to said second eccentric bushing, said second joint having one part secured to said second eccentric bushing and one part secured to said coupling rod, whereby said coupling rod may be swung out of the area of said first and second frame openings for accommodating changing of said slip-on sleeves on said first and second printing cylinders, respectively.

15. The device according to claim 14, further comprising a swing member for swinging said coupling rod out of said frame openings, said swing member comprising a pair of pressure operated working cylinders pivotally mourned to the frame and joined to the coupling rod whereby each of said working cylinders acts to separate one of said first and second separable joins for moving said coupling rod out of said first and second frame openings, respectively.

16. The device according to claim 1, wherein said printing machine includes a second printing cylinder moveable between print engagement and disengagement positions and equipped with a slip-on sleeve, and a second eccentric bushing for said second printing cylinder, and wherein said frame includes a second opening for accommodating changing of said slip-on sleeve on said second printing cylinder, wherein said device further comprises a second coupling rod adjacent said second frame opening for reciprocating said second eccentric bushing for moving said second printing cylinder between said print engagement and disengagement positions, a second separable joint joining said second coupling rod to said second eccentric bushing, said second joint having one part secured to said second eccentric bushing and one part secured to said second coupling rod, whereby said second coupling rod may be swung out of the area of said second frame opening for accommodating changing of said slip-on sleeve of said second printing cylinder.

17. The device according to claim 1, further comprising a swing member for swinging said coupling rod out of the area of said frame opening, said swing member comprising an electromotor.

18. The device according to claim 17, wherein said electromotor comprises an electrical linear drive.

19. The device according to claim 1, wherein said slip-on sleeve has an outer resilient layer and wherein said printing machine is for one-sided or double-sided indirect printing.

* * * * *